US005259374A

United States Patent [19]

Miller et al.

[11] Patent Number: 5,259,374

[45] Date of Patent: Nov. 9, 1993

[54] DIVER ADJUSTABLE CONTROL FOR UNDERWATER BREATHING APPARATUS

[76] Inventors: Russell L. Miller, 3330 Creek Hollow Dr.; Eric C. Linden, 3320 Creek Hollow Dr., both of Atlanta, Ga. 30062

[21] Appl. No.: 898,018

[22] Filed: Jun. 12, 1992

[51] Int. Cl.[5] ..... A62B 9/02

[52] U.S. Cl. ..... 128/205.24; 128/204.26; 128/200.24; 137/908; 251/360

[58] Field of Search ..... 137/327, 908; 251/360, 251/363; 7/165; 81/436, 451, 458, 461, 457; 128/200.24, 204.26, 205.24, 207.12

[56] References Cited

U.S. PATENT DOCUMENTS

| | | | |
|---|---|---|---|
| 3,783,891 | 1/1974 | Christianson | 137/491 |
| 4,041,977 | 8/1977 | Matsuno | 137/494 |
| 4,041,978 | 8/1977 | Leeman | 137/494 |
| 4,140,112 | 2/1979 | Kobzan | 128/204.25 |
| 4,214,580 | 7/1980 | Pederson | 128/204.26 |
| 4,267,858 | 5/1981 | Lewis | 137/327 X |
| 4,354,520 | 10/1982 | Easley, Jr. | 137/908 X |
| 4,356,820 | 11/1982 | Trinkwalder | 128/204.26 |
| 4,503,852 | 3/1985 | Christianson | 128/204.26 |
| 4,616,645 | 10/1986 | Pederson | 128/204.26 |
| 4,798,202 | 1/1989 | Chambonnet | 128/204.26 |
| 4,862,884 | 9/1989 | Christianson | 128/204.26 |
| 5,035,238 | 7/1991 | Christianson | 128/204.26 |
| 5,042,473 | 8/1991 | Lewis | 128/205.24 |
| 5,107,882 | 4/1992 | Carroll | 137/327 |

FOREIGN PATENT DOCUMENTS

| | | | |
|---|---|---|---|
| 709960 | 8/1941 | Fed. Rep. of Germany | 137/908 |
| 1027516 | 6/1956 | Fed. Rep. of Germany | 137/908 |
| 1185065 | 1/1957 | Fed. Rep. of Germany | 137/908 |
| 1252462 | 12/1960 | France | 137/908 |
| 910548 | 11/1962 | United Kingdom | 137/908 |
| 1401613 | 7/1975 | United Kingdom | 137/908 |

*Primary Examiner*—Edgar S. Burr
*Assistant Examiner*—Eric P. Raciti
*Attorney, Agent, or Firm*—Harry I. Leon; Vivian L. Steadman

[57] ABSTRACT

A control device for an air inlet valve to a second stage regulator for an underwater breathing apparatus which allows a diver, while wearing the apparatus, to adjust the amount of suction pressure required to activate the air inlet to his mouthpiece. The device comprises a small cylindrical structure and a micrometer-type adjustment screw threadedly engageable with an interior wall of the structure. The structure fits on the air inlet to the second stage regulator and is fluidly connected thereto in such a way that any air entering the regulator must pass through a channel formed in the shaft of the screw. The manually adjustable, micrometer-type adjustment screw, when turned, resets biasing means on the normally closed air inlet valve, altering the suction pressure which the user must supply to open the valve. In addition, the air inlet for the control device, when it is fitted to the regulator, is disposed at a 90 degree angle to the air inlet for the regulator alone. This air inlet configuration for the control device and regulator combination allows the supply line thereto to fit more closely about the user's body that the line does when connected to a conventional regulator. This configuration also helps to prevent the line from becoming snarled during a dive.

5 Claims, 2 Drawing Sheets

FIG. 2.
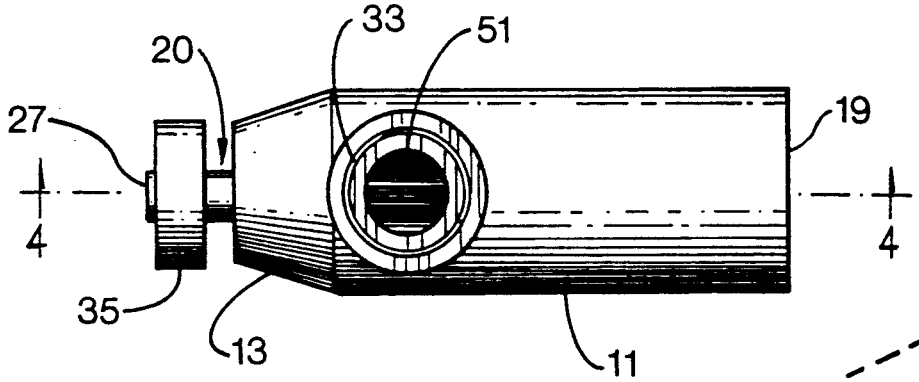
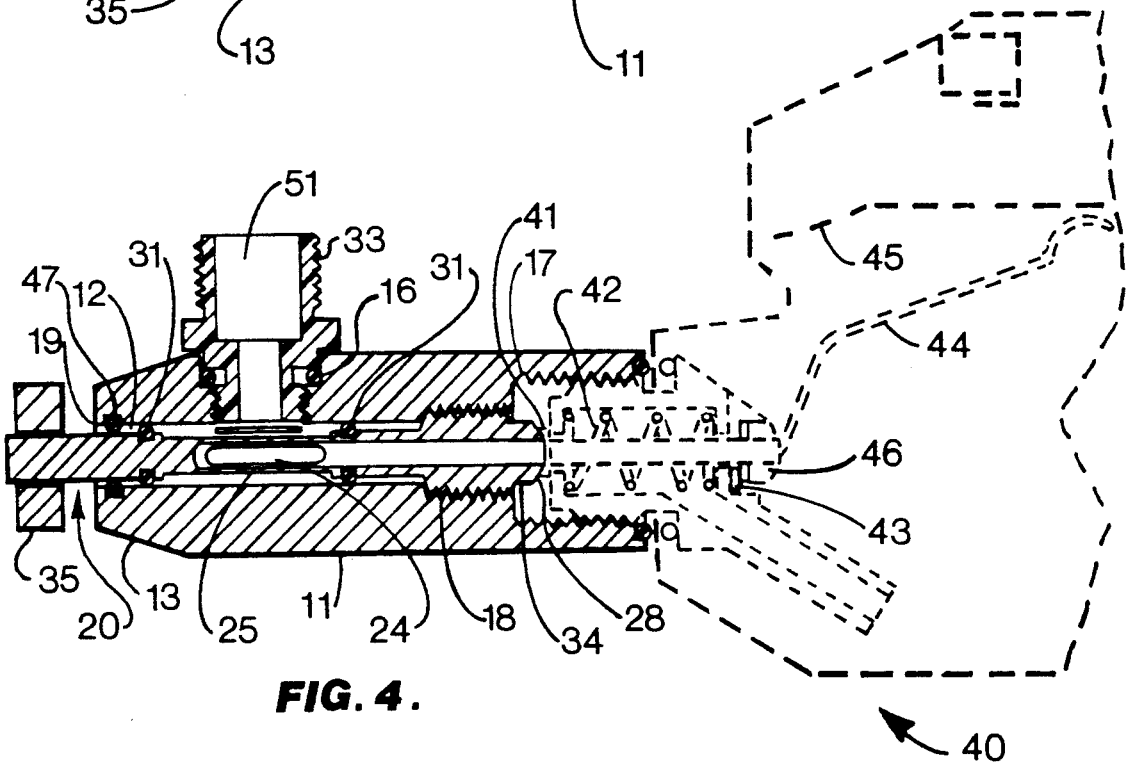
FIG. 4.
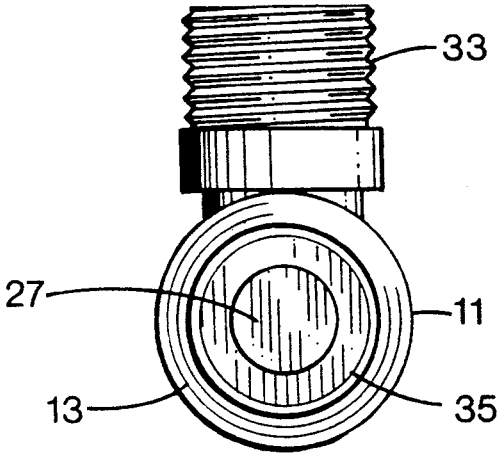
FIG. 3.

DIVER ADJUSTABLE CONTROL FOR UNDERWATER BREATHING APPARATUS

BACKGROUND OF THE INVENTION

The present invention relates to improvements in the second stage pressure regulators of a self-contained underwater breathing apparatus, popularly denoted by the acronym "scuba", and in particular to a device for manually adjusting, during a dive, the inhalation suction pressure required for opening the air inlet valve of the second stage regulator.

Compressed air, which is carried in cylinders by scuba divers, is expanded in two stages. First, the air is expanded through a pressure-reducing valve fixed to each of the cylinders. During this initial expansion, the pressure of the air is reduced from a high pressure, typically in excess of 2000 psi, to an intermediate pressure which is about 150 psi above ambient. Air at the intermediate pressure is then supplied through a flexible conduit or air supply hose to a second stage regulator where the air undergoes a further expansion.

In order to prevent the leakage of air during a dive, scuba divers use a breathing apparatus equipped with a demand-type, second stage regulator having an air inlet valve which remains closed, under the influence of spring biasing means, when the diver is not inhaling. In a typical second stage regulator, such as the one disclosed by Chambonnet, U.S. Pat. No. 4,798,202, a normally closed air inlet valve is mechanically levered to provide air flow when a diaphragm, which is exposed to ambient pressure, is pulled inwardly. This inward pull is provided by the combination of ambient pressure and suction created as a result of the diver's inhalation effort. The amount of suction necessary to open the valve varies inversely with the depth of a dive. At greater depths, increased water pressure causes the diaphragm to push more forcefully against the lever. Less suction is then required to open the valve.

Because of the variations in water pressure commonly experienced by scuba divers, the biasing means must be reset each time a diver plans to swim at a significantly different depth than on his last dive. Proper adjustment of the biasing means is thus critical. When a diver uses his breathing apparatus at a shallower depth than that for which it was adjusted, he must, in order to overcome the spring biasing means, inhale with considerably greater effort than is normally required. Conventional second stage regulators regulators are usually set to perform optimally at a depth of 90 feet. But with this setting, a diver finds that at shallow depths, he must supply 1 inch Hg or more vacuum cracking pressure, requiring very unnatural breathing, to open the air inlet valve. On the other hand, if a conventional second stage regulator were to be set for optimum performance near the surface, the air inlet valve would be free-flowing at 90 feet.

Most regulators, including Chambonnet's, must be disassembled before the biasing means can be reset. An exception is a regulator disclosed by Christianson in U.S. Pat. No. 4,862,884, having biasing means with both coarse and fine adjustment means, the latter being externally adjustable. Unfortunately, the range over which the biasing means in this prior art device can be finely tuned is quite limited. Moreover, Christianson's regulator must be disassembled in order to reset the coarse adjustment means. As a consequence, most divers must rely on qualified technicians at diving shops for assistance in resetting the biasing means.

SUMMARY OF THE INVENTION

An object of the present invention is to provide a control device, adapted to be mounted externally on any one of many different models of standard second stage regulators for scuba, the device allowing the biasing means to be manually reset to provide optimum breathing over 100 percent of the range of depths normally encountered in sport diving.

A further object of the present invention is to provide a control device, which when mounted on a standard second stage regulator, overcomes any limitations inherent in such a regulator due to the biasing means for its air inlet valve not responding optimally at more than one depth, or outside a narrow range of depths, without the regulator first being disassembled and the biasing means reset in a shop.

In accordance with the present invention, there is provided a control device which works directly on the biasing means used for maintaining an air inlet valve to a standard second stage regulator in a normally closed position, the device allowing a diver to manually reset, while diving, the inhalation suction pressure required to open the valve, so that he may experience breathing with very little resistance at each level at which he may be swimming throughout his dive. In each of these regulators, the biasing means is part of a mechanism controlling how far suction from the diver's inhalation effort must pull a diaphragm on the regulator in order to open the air inlet valve.

In use, the device is mounted on the regulator by simply removing its air supply hose and coupler, as required, and securing the device in its place using inner threads formed in one end of the device which are identical to those of a fitting employed in the prior art to connect the air supply hose to the regulator. The air supply hose itself is then attached directly to the device.

The device comprises a shaft, which is its only essential moving part, and a small elongated cylindrical housing. The housing includes a first interior wall which defines a longitudinal passageway through which the shaft extends, the shaft protruding longitudinally from both ends of the passageway. The shaft and the interior wall are formed respectively with a first set of outer and inner threads for telescopically threading together.

The housing further includes a second interior wall formed with interior threads for threadedly engaging exterior threads on a standard air inlet fitting such as is found on many of the second stage regulators currently on the market, including such models as SEA ELITE, ALPHA OCEANIC, TUSA, IDI, DACOR, SHERWOOD, PARKWAY ATLAS, and BEUCHAT VS. The spring in the biasing means in these models, as well as others which can be adapted for use with the present control device, is aligned longitudinally with, and centered with respect to, the longitudinal axis of the exterior threads formed on the standard air inlet fitting. To accomodate variations in the designs of the air inlets of various regulator models, embodiments of the control device are provided which have shafts of different lengths. Only small differences in length exist between the shafts required to fit the recited models.

In the preferred embodiment, the shaft defines a transverse aperture and a channel, the channel communicating with the aperture and extending generally longitudinally from the aperture to the first end. The aperture itself fluidly communicates with an air inlet to the cylindrical housing which is disposed transversely to the longitudinal passageway. A pair of flexible annular members, between which the aperture is located, are retained in position between the shaft and the interior wall of the longitudinal passageway to insure that any air from the air supply leaving the control device exits through the channel between the first end and the biasing means rather than escaping through the passageway.

The device further comprises means, including a knob attached to a portion of the shaft which protrudes externally from the housing, for manually rotating the shaft within the housing so as to move the shaft longitudinally. The length of travel of the shaft is sufficient to bring its first end to bear against a portion of the biasing means through which force can be transmitted to compress the spring, altering the setting of the biasing means. Since in the second stage regulator models recited herein, only a small change in the length of the spring has a large effect on the inhalation suction pressure required to open the air inlet valve, rotating the shaft at most a few turns, especially when the first set of threads is relatively fine, can achieve a setting of the biasing means which allows a diver to adjust his regulator to an optimum inhalation suction pressure for each depth of his dive. The adjustability offered by the control device allows divers to use inexpensive regulators which have been modified to incorporate the control device and obtain performance from them which is equal to or better than that obtainable from most expensive models.

In use, as the diaphragm of the regulator is depressed ever more inwardly with the increasing depth of a dive, the diver can turn the shaft so as to advance it further against the biasing means. The biasing means is optimally set at the point in which air flow through the air inlet valve just stops when the diver is not inhaling. Then only a slight inhalation suction pressure from the diver is sufficient to move the diaphragm a small distance further to open the air inlet valve. Due to the positive demand requirement, air useage is reduced at all depths. Also, surges of air flow which occur as a rule with most regulators are nearly totally eliminated. With the control device according to the present invention, the vacuum cracking pressure, even just below the surface, is only 0.3 to 0.6 inches Hg.

With the air inlet of the device preferably disposed perpendicularly to its longitudinal passageway, the device also provides for the air supply hose to be connected at a 90 degree angle to the longitudinal axis of the air inlet to the regulator on which the device is mounted. This provision allows for the air supply hose to be fitted more closely about the diver's body than would otherwise be the case, reducing the likelihood of the hose becoming snarled during the dive.

BRIEF DESCRIPTION OF THE DRAWINGS

FIG. 2 is a plan view showing the control device according to the present invention;

FIG. 3 is a end elevation view of the control device on an enlarged scale; and FIG. 4 is a cross section 4—4 through the control device according to FIG. 2, the control device being shown in mounted position on a second stage regulator, a fragmentary section of the regulator being illustrated in dashed lines; for ease of illustration, the control device being shown in a position which is rotated 90 degrees relative to the mounted position assumed by the control device during use.

DESCRIPTION OF THE PREFERRED EMBODIMENT

Figure 1:
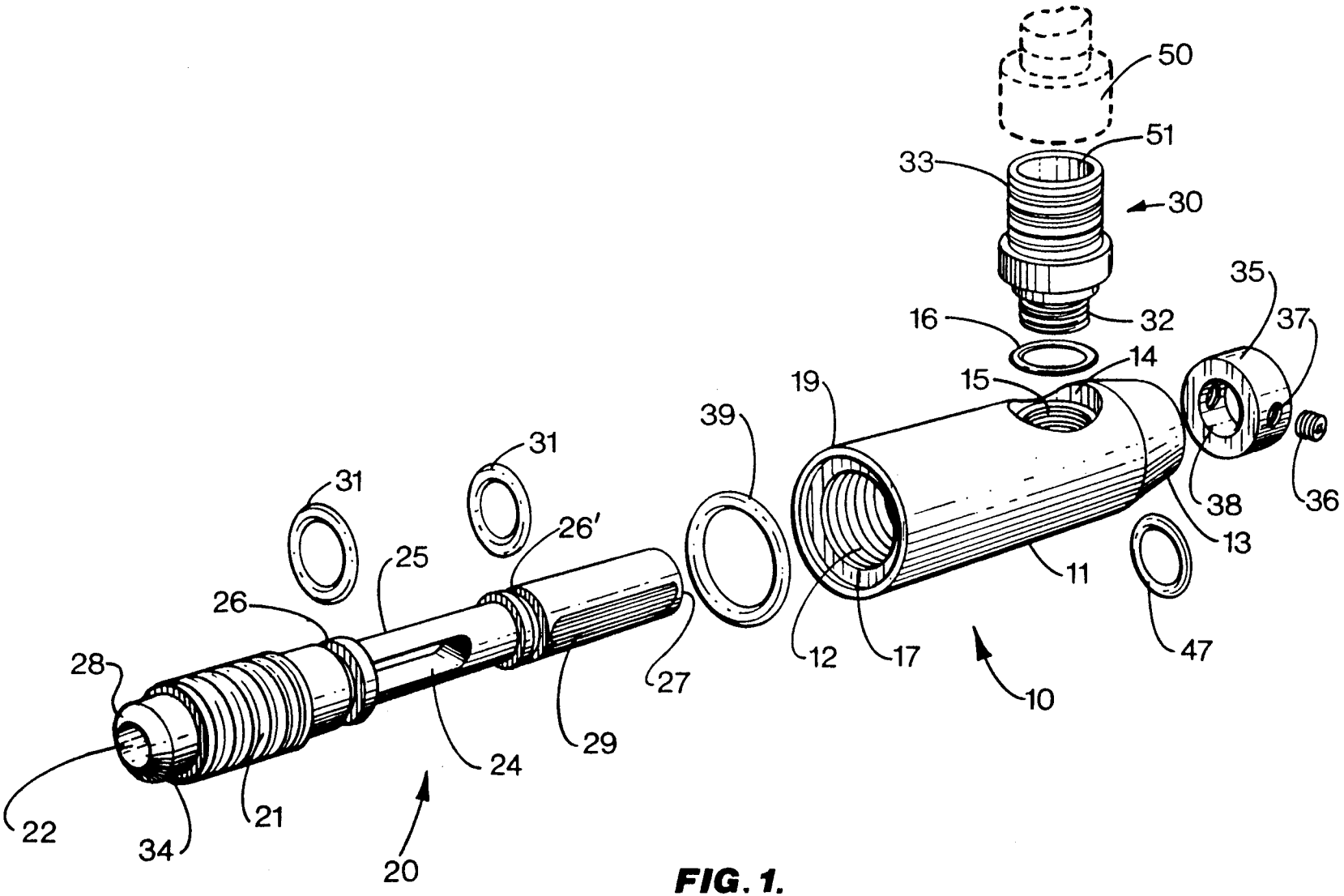
FIG. 1 is an exploded view showing in perspective all of the parts of the control device according to the present invention shown in assembled form in FIG. 2.

FIG. 4 shows the present invention in conjunction with a conventional second stage regulator 40. Such a regulator for purposes of illustration is the DACOR model "PACE AERO". The regulator 40 includes a diaphragm 45 which is pulled inwardly (downwardly in FIG. 4), as a diver inhales, pushing against a lever arm 44 and causing it to pivot about a nut 46 holding a heel 43 on the arm. As the arm 44 pivots inwardly, the heel 43 pushes on the nut 46, working against spring biasing means 42 to move a seat 41 inwardly. A set screw (not shown) cooperates with the seat 41, which is typically formed of flexible, resilient rubber or plastic, to form a seat valve. When the seat 41 is moved inwardly and away from the set screw to a sufficient extent, the seat valve is cracked or opened slightly, admitting intermediate pressure breathable air through an air supply hose 50 connected to the air inlet of the regulator 40.

In the prior art, biasing means 42 is roughly set, for a particular depth, by disassembling the regulator 40 and having a qualified technician adjust the position of the nut 46 by turning it. Then biasing means 42 is finely tuned by disconnecting the air supply hose 50 from the air inlet and having a qualified technician adjust the set screw (not shown) in a shop.

Loosening the nut 46 too much for a given ambient pressure allows the arm 44 to move away from the diaphragm 45 so that an inhalation suction pressure which is substantially greater than that required for natural breathing is required to move the valve seat 41 inwardly to open the air inlet valve. On the other hand, tightening the nut 46 so that the inhalation suction pressure is optimal at a shallow depth results in the air inlet valve being free-flowing at sufficiently greater depths.

In the illustrated embodiment, a device according to the present invention is indicated generally by the numeral 10. Prior to installing the device 10 in a conventional second stage regulator 40, the air supply hose 50 is disconnected; and, if an adjustment set screw located upstream of the seat 41 has been provided with the regulator, this set screw is removed.

The device 10 comprises a shaft 20 and a cylindrical housing 11 with a tapered end 13 and an interior wall defining a longitudinal passageway 12. The interior wall and the shaft 20 are formed respectively with inner threads 18 and 21 for telescopically threading together as shown in FIGS. 1 and 4. The threads 18 and 21, which are preferably relatively fine threads of say 32 threads per inch, provide for longitudinal movement of the shaft 20. By turning an external knob 35 affixed to the shaft 20, a diver can advance or retract the shaft 20 relative to the valve seat 41, so that the inhalation pressure required for cracking the valve seat can be optimized by the diver while he is swimming.

The housing 11 further comprises means for fluidly connecting an air supply to the longitudinal passageway 12. The air supply connecting means comprises a first bore having a shoulder 14 and inner threads 15, the first bore being formed in a sidewall of the housing 11 proximate with the end 13 and disposed generally perpendicularly to the passageway 12. In the preferred embodiment, a fitting 30 is also provided having outer threads 32 and 33 which, in use, are interconnected, respectively, with the threads 15 and with threads (not shown) of a connector for the air supply hose 50. The shoulder 14, which is located contiguous with the threads 15, functions as a sealing surface for an O-ring 16.

The housing 11 still further comprises means for fluidly connecting the longitudinal passageway 12 to the air inlet valve, the connecting means including a second bore having interior threads 17 for securing the housing to exterior threads on air inlet connection means for a conventional second stage regulator 40 (FIG. 4). The second bore is disposed parallel to and contiguous with the passageway 12. In those regulators having interior threads, rather than exterior threads, for connecting an air supply hose, a short nipple (not shown) can be used to adapt the interior threads so that the housing 11 can be mounted on this additional type of regulator.

As illustrated in FIG. 4, the shaft 20 fills much of the longitudinal passageway 12 and extends from both ends thereof, a tapered tip 28 on the shaft being juxtaposed with the seat 41. In the preferred embodiment, the shaft 20 defines at least one transverse aperture 24 and a channel 22 fluidly connected thereto. The channel 22 extends from the aperture 24 to the tapered tip 28. Means for sealing the longitudinal passageway 12 so that only a section thereof proximate with the aperture 24 is fluidly connected to the air supply comprises a pair of annular flexible members such as O-rings 31 and a pair of grooves 26, 26'. The grooves 26, 26', which are formed in the shaft 20, comprise means for retaining the O-rings 31 in position between the shaft 20 and the interior wall of the passageway 12. The grooves 26, 26' are spaced apart from each other, with the aperture 25 being disposed between them. In addition, a safety O-ring 47 is preferably supplied to back up the seal provided by the O-ring 31 proximate with the tapered end 13 of the housing 11. Also, a segment 25 of the shaft 20, including that portion of the shaft defining the aperture 24 and located between the grooves 26, 26', is narrower in cross-section than the remainder of the shaft, facilitating movement of air from the air supply through the sealed section of the longitudinal passageway 12 and into the aperture.

In use, the tapered tip 28 on the shaft 20 cooperates with the seat 41 to form a seat valve for the intermediate pressure air in the channel 22. The seat valve closes when the tip 28 presses into and slightly deforms the seat 41, forming an air-tight seal between the tip and the seat.

As is best illustrated in FIG. 1, an end of the shaft 20 distal from the tapered tip 28 preferably defines a flattened section 29. The section 29 is provided to accommodate a set screw 36 engageable with threads 37 formed in the knob 35 or the like for fixedly attaching the knob to the shaft. In the initial setup of the device 10, the diver holds down the purge button (not shown) on the regulator 40, then screws in the shaft 20 until he gets a minimum purge, and finally slides the knob 35 against the cylindrical housing 11 before tightening the set screw 36.

When right-handed threads are used for the inner threads 18, counterclockwise turning of knob 35 moves the tapered tip 28 on the shaft 20 away from the valve seat 41. As the pressure on the valve seat 41 is reduced, less force is exerted on the spring 42 which translates into less force being present to oppose the nut 46 acting on the heel 43 of the lever arm 44. The net effect of moving the tip 28 away from the seat 41 is to reduce the inhalation suction pressure required to pull the diaphragm 45 inwardly to open the air inlet valve.

In operation, an air supply hose 50 is connected to the hose adapter 33. Air enters first the fitting 33 through an opening 51 formed therein and then the cylindrical housing 11. Flowing around the narrowed section 25, sealed between the O-rings 31, the air is directed into the aperture 24 and then, turning, exits through the channel 22 past the seat 41 and into the second stage regulator 40. By turning the knob 35, a diver can adjust the desired inhalation suction pressure to his individual needs. An increase in the external pressure on the diaphragm 45 of the regulator 40, such as occurs with increasing depth, diminishes the inhalation suction pressure which the diver must supply to activate the air inlet valve. Readjusting the required suction pressure simply is readily accomplished with the device 10. Simply by turning the knob 35 a few turns, the diver can adjust the suction pressure to accomodate even large changes in the depth of a dive.

As a safety measure, the travel of the shaft 20 in a direction toward of an edge 19 of the housing 11 distal from the threads 18 is limited: the threads 18 have been formed with an outside diameter which is larger than the bore of the passageway 12.

The device 10 can be easily adapted to fit many different second stage regulator models provided they are equipped with a valve seat biased by a spring which is disposed with its longitudinal axis disposed parallel with the threads on the air supply connection to the air inlet of the regulator. To accomodate differences commonly found between these models, embodiments of the device 10 are provided in which a segment 34 of the shaft 20 spanning the distance between the threads 21 and the tapered tip 28 has a length which is in the range of zero to about 1 inch.

It is understood that those skilled in the art may conceive other applications, modifications and/or changes in the invention described above. Any such applications, modifications or changes which fall within the purview of the description of the description are intended to be illustrative and not intended to be limitative. The scope of the invention is limited only by the scope of the claims appended hereto.

I claim:

1. A control device mountable on a second stage regulator in a breathing apparatus, the regulator having biasing means for maintaining an air inlet valve including a seat in a normally closed position, when the regulator is fluidly connected to an intermediate pressure air supply, the control device comprising:

(a) an elongated housing having at least one interior wall defining a longitudinal passageway;

(b) an elongated shaft interconnected with the housing through a set of threads, the shaft having a first end protruding longitudinally from the housing into the regulator; the shaft being rotatably engageable with the housing and having a length of travel sufficient to press the first end into said seat;

(c) the shaft having at least one transverse aperture and a channel, the channel communicating with the aperture and extending generally longitudinally from the aperture to said first end;

(d) at least one pair of flexible annular members spaced apart from each other, means for retaining the annular members in position between the shaft and the interior wall of the longitudinal passageway; the aperture being disposed between the pair of annular members;

(e) means for fluidly connecting the air supply to the longitudinal passageway at points disposed between said pair of flexible annular members; and (f) means attached to the shaft at points thereon distal from the first end for manually adjusting the length of travel of the first end of the shaft.

2. A control device mountable on a second stage regulator in a breathing apparatus, the regulator having biasing means for maintaining an air inlet valve including a seat in a normally closed position, when the regulator is fluidly connected to an intermediate pressure air supply, the control device comprising:

(a) an elongated housing having at least one interior wall defining a longitudinal passageway;

(b) an elongated shaft interconnected with the housing through a set of threads, the shaft having a first end protruding longitudinally from the housing into the regulator; the shaft being rotatably engageable with the housing and having a length of travel sufficient to press the first end into said seat;

(c) the shaft having at least one transverse aperture and a channel, the channel communicating with the aperture and extending generally longitudinally from the aperture to said first end;

(d) means disposed between the shaft and the interior wall for sealing a section of the longitudinal passageway fluidly connected to the aperture against loss of air at intermediate pressure;

(e) means for fluidly connecting the air supply to said section of the longitudinal passageway; and (f) means for manually adjusting the length of travel of the first end of the shaft when the air supply is fluidly connected to said section of the longitudinal passageway.

3. The control device according to claim 2 wherein the means for fluidly connecting the air supply to said section of the longitudinal passageway further comprises the housing having a sidewall and means for connecting the air supply to the sidewall.

4. A control device mountable on a second stage regulator for a breathing apparatus, the regulator having biasing means for maintaining an air inlet valve including a seat in a normally closed position, when the regulator is fluidly connected to an intermediate pressure air supply, the control device comprising:

(a) a housing defining a passageway; and (b) means disposed in the passageway for manually adjusting the biasing means, the adjusting means defining a hollow structure through which pressurized air can flow from the passageway to the seat, said structure being manually adjustable in position relative to the seat at the same time the air supply is fluidly connected to the passageway.

5. The control device according to claim 4 wherein the means for manually adjusting the biasing means further comprises a shaft connected to the hollow structure, said shaft having an end distal from the hollow structure, the end protruding from the housing and having means attached thereto for manually adjusting the position of the hollow structure.

* * * * *